United States Patent [19]

Schroter

[11] 4,044,517

[45] Aug. 30, 1977

[54] INSULATED TANK JACKETING SYSTEM

[75] Inventor: Richard C. Schroter, Orinda, Calif.

[73] Assignee: Kaiser Aluminum & Chemical Corporation, Oakland, Calif.

[21] Appl. No.: 704,725

[22] Filed: July 12, 1976

[51] Int. Cl.[2] ..... B65D 25/16

[52] U.S. Cl. ..... 52/248; 52/249; 52/489; 52/588; 52/726; 220/9 LG; 220/15

[58] Field of Search ..... 220/9 LG, 9 A, 15; 403/309, 313, 300, 363; 52/489, 528, 588, 249, 404, 726, 410, 710, 246, 247, 248, DIG. 6

[56] References Cited

U.S. PATENT DOCUMENTS

| | | | |
|---|---|---|---|
| 1,253,764 | 1/1918 | Zahner | 52/489 X |
| 1,780,232 | 11/1930 | Hayman | 220/306 |
| 2,035,764 | 3/1936 | Rowell | 52/247 |
| 2,323,297 | 7/1943 | Collins | 220/63 R |
| 2,946,414 | 7/1960 | Gordon | 52/726 X |
| 2,955,686 | 10/1960 | Blomeley et al. | 52/248 |
| 3,113,691 | 12/1963 | Jezowski | 220/9 A |
| 3,300,934 | 1/1967 | Waizenhofer | 52/489 X |
| 3,339,778 | 9/1967 | Herrenschmidt | 220/15 X |
| 3,968,624 | 7/1976 | Allmendinger | 403/363 X |
| Re. 27,330 | 4/1972 | Marcmann | 52/248 |

FOREIGN PATENT DOCUMENTS

| | | | |
|---|---|---|---|
| 2,109,117 | 9/1972 | Germany | 403/363 |
| 1,187,650 | 2/1965 | Germany | 220/9 A |

OTHER PUBLICATIONS

Zip-Rib, Owen/Corning Fiberglas, 6 pages, June 1975.

*Primary Examiner*—Leslie Braun
*Attorney, Agent, or Firm*—Paul E. Calrow; John S. Rhoades

[57] ABSTRACT

An improved jacketing system for storage tank structures wherein insulated panels are attached to modular tracks mounted in horizontal courses on the outside walls of the tanks. The individual tracks are made up of modular segments secured together both by splice plates and take-up devices in an improved pretensioned fashion to provide for an efficient mounting of the panels on a tank wall.

8 Claims, 9 Drawing Figures

INSULATED TANK JACKETING SYSTEM

BACKGROUND OF THE INVENTION

Various arrangements or systems have been provided in the past for securing insulated panels of the type shown and discussed in U.S. Pat. Nos. 3,312,028 and 3,555,758 to storage tanks. Such systems as indicated in a current brochure of the Owens-Corning Fiberglas Company and entitled "Zip-Rib Tank Insulation System" published in June, 1975, contemplate that the tracks disposed interiorly of the insulation and employed for mounting the insulated panels to a tank would be fastened to anchoring studs that had been previously welded to the outside wall of the tank structures. The difficulty with such an arrangement, however, is that at times this stud welding operation can pose explosion hazards. In other instances the condition of a given tank wall is such that it will not readily accept a stud weld. In still other instances, while outside tension bands are well-known devices for securing insulated jacketing to storage tanks to compensate for expansion and contraction, they have not always been as efficient as possible or easy to assemble and install in place.

In prior practice, the usual bands comprise strips of stainless steel on two foot centers which are applied exteriorly of the jacketing and require, in addition to more materials, special spring devices along their lengths to allow the bands to expand and contract commensurate with the thermal expansion and contraction of the tank relative to the jacketing so as to maintain the jacketing in proper contact with the tank at all times. Further disadvantages attendant upon the use of exterior rather than interiorly disposed insulation mounting tracks are that they are more susceptible to damage and corrosion problems.

The instant development is designed to help overcome the aforesaid tank jacketing problems by securing modular track segments together underneath the tank insulation in an improved fashion to form a substantially continuous hoop or circular track by the use of easy to install splice plates and take-up elements which are located at various strategic points along an overall track. These plates and take-up devices help the track accommodate itself to variations in the dimensions of a storage tank, while maintaining sufficient tension in the track to resist suction forces of the wind. Being under the insulation, the track tends to maintain substantially the same temperature as that of the tank at all times so as to remain substantially the same relative size regardless of the operating temperature inside the tank. This, in turn, helps to ensure that the insulated panels of the tank jacketing will be maintained in place without distortion or buckling and the integrity of the track system used to mount the panels in place generally maintained even during severe buffeting of the panels by the winds.

The advantageous features of the instant invention to be further described are believed to constitute improvements over the various insulation mounting systems for storage tanks and/or specific parts thereof disclosed in the aforesaid Owens-Corning Fiberglas brochure and/or in one or more of the following U.S. Pat. Nos. 2,955,686; 2,355,947; 2,323,297; 2,620,906; 2,857,995; 3,339,778; 3,903,671; 3,300,934; 3,708,943; 3,392,220; 3,948,412 and U.S. Pat. No. 27,330 as well as the joints make from interlocking elements, such as are shown in U.S. Pat. Nos. 1,189,052; 1,780,232; 2,531,349 and 2,633,266.

SUMMARY OF THE INVENTION

DETAILED DESCRIPTION

Figure 1:
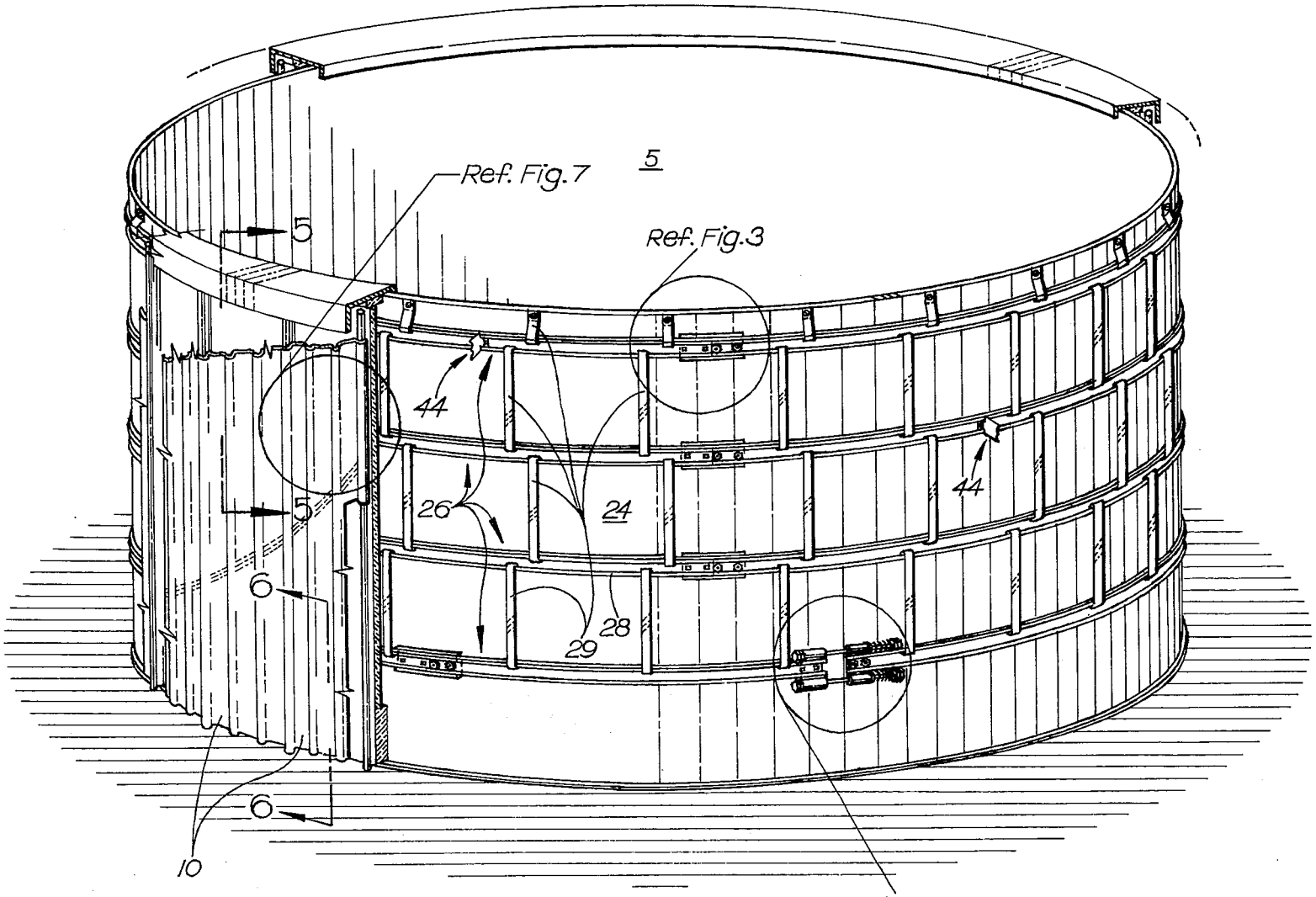
FIG. 1 is an overall perspective view with parts broken away of a typical cylindrical storage tank structure provided with the improved insulated jacketing system of the instant invention.
Figure 7:
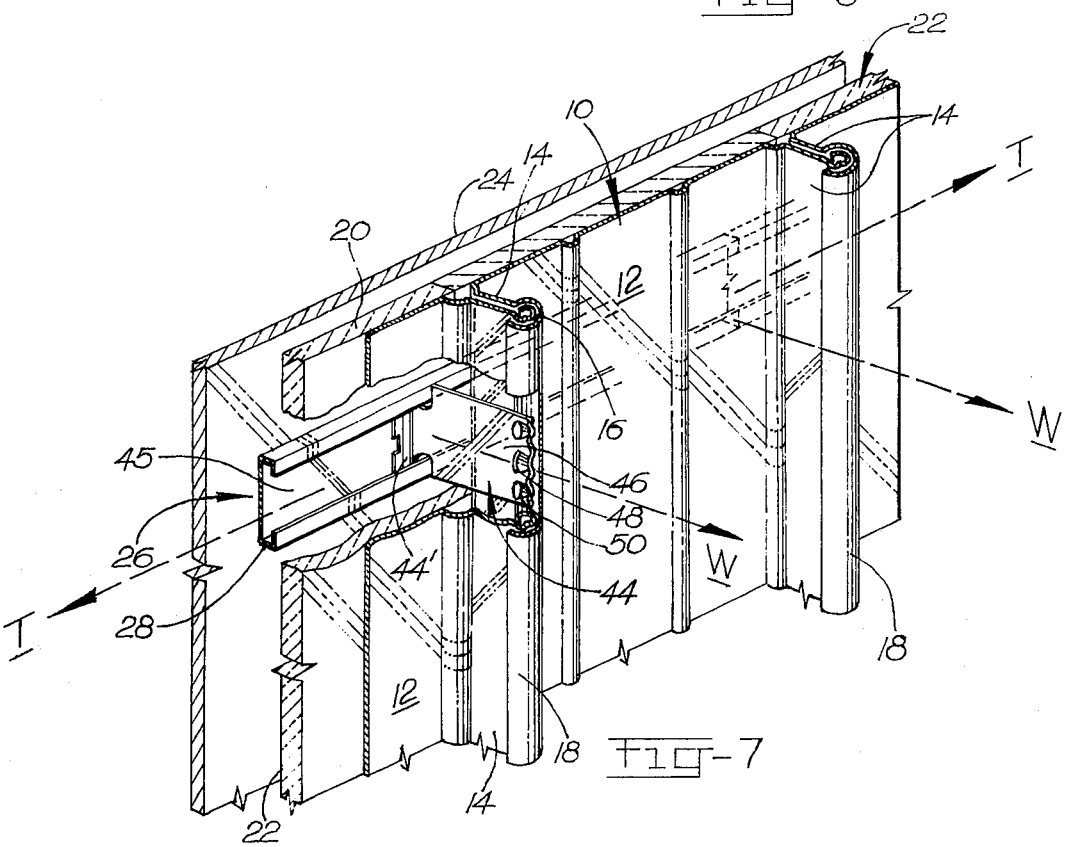
FIG. 7 is a broken perspective view taken generally within the circumscribing circle 7 of FIG. 1 and discloses the manner in which the insulated panels are secured together as well as being anchored to the tracks.

With further reference to the drawings and in particular FIGS. 1 and 7, a preferred embodiment of the tank jacketing system of the instant invention contemplates using the insulated or composite panels 10 of the type generally shown in U.S. Pat. No. 3,555,758. Composite panel 10 is generally comprised of a channel-shaped, roll formed metal section 12 that can be ribbed if desired. The opposed edges of section 12 are provided with upstanding flanged portions 14. One of these flanged portions includes a rolled terminal bead 16, while the other flanged portion 14 includes a deformable sleeve 18 that is adapted to be folded tightly about the bead 16 on a similarly configured panel when a pair of such panels are disposed in adjoining relationship. Panels 10 are backed with a suitable rigid insulating material layer, such as one made of expanded polyurethane foam 20 adhesively secured to the underside of the panels. If desired the bottom exposed surface of the insulating layer 20 can be further covered by a vapor barrier element 22 of thin aluminum foil or other moisture impervious material in the manner shown in U.S. Pat. No. 3,555,758.

Figure 2:
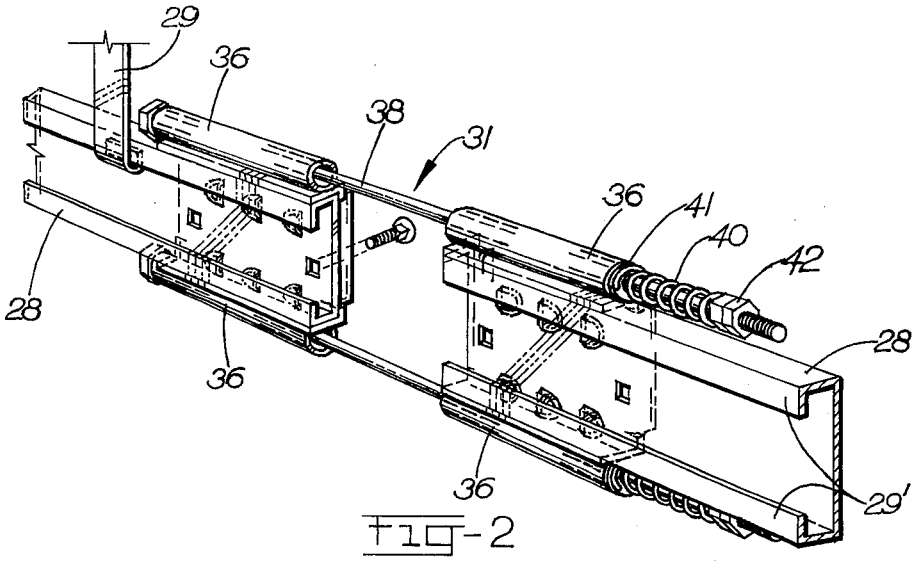
FIG. 2 is a broken perspective view taken within the circumscribing circle 2 of FIG. 1 and discloses a take-up device that can be used with the insulating system of the instant invention.
Figure 3:
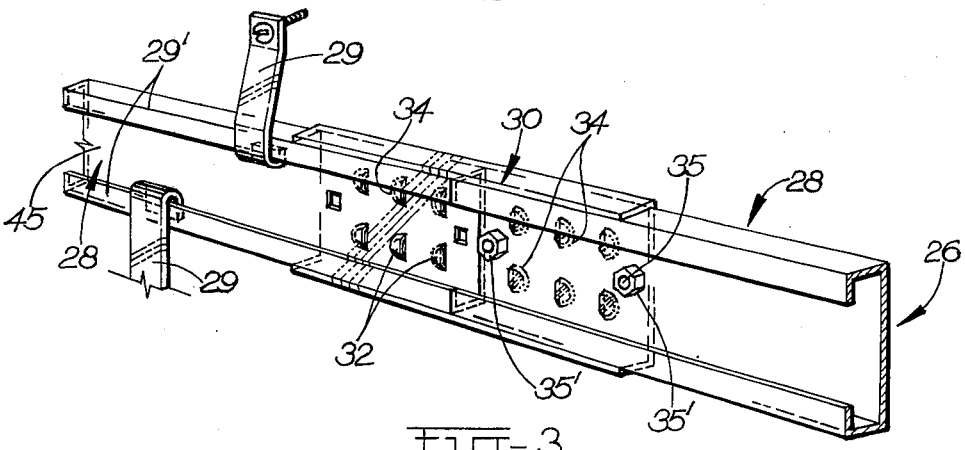
FIG. 3 is a broken perspective view of a splice plate arrangement that forms part of the instant invention when taken within the circumscribing circle 3 of FIG. 1.
Figure 4:
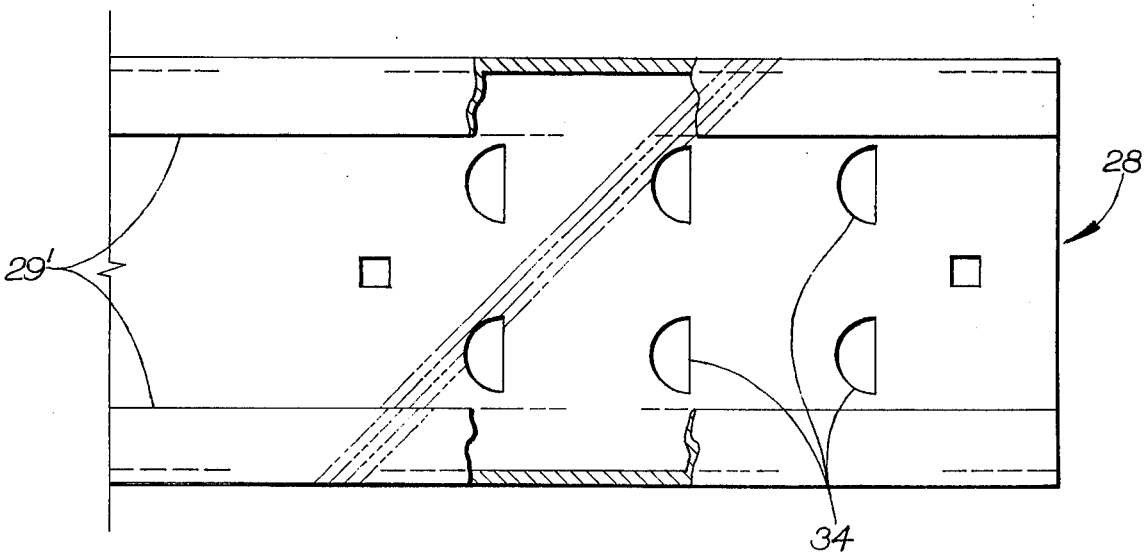
FIG. 4 is a fragmentary view of a portion of a track segment end showing the apertures formed therein.
Figure 5:
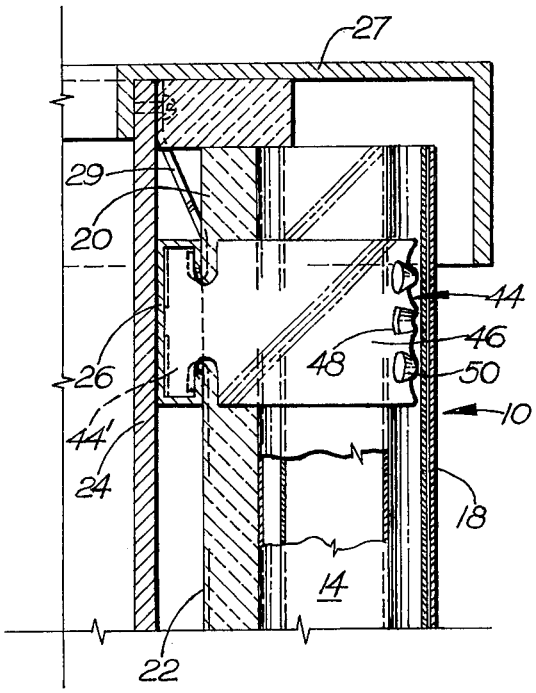
FIG. 5 is a sectional view generally taken along the line 5—5 of FIG. 1 with parts added.
Figure 6:
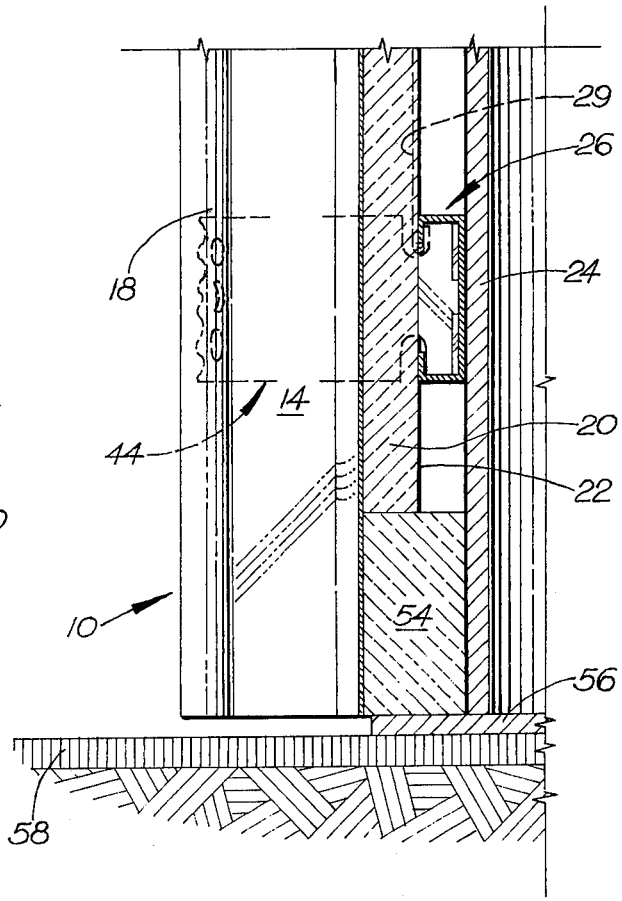
FIG. 6 is a sectional view taken generally along the line 6—6 of FIG. 1.
Figure 8:
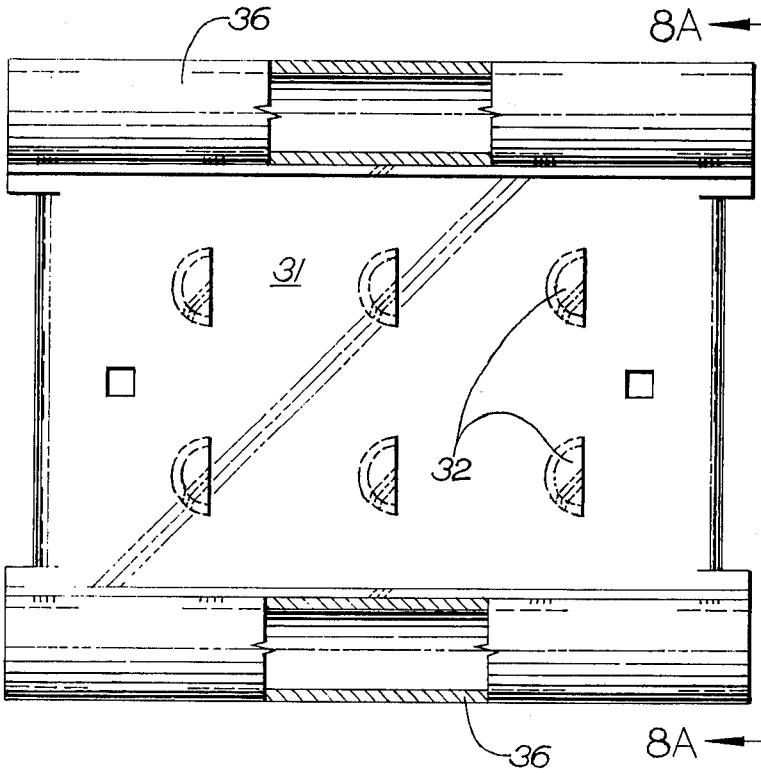
FIG. 8 is an elevational end view of a take-up plate shown in FIG. 2 with parts removed.
Figure 8A:
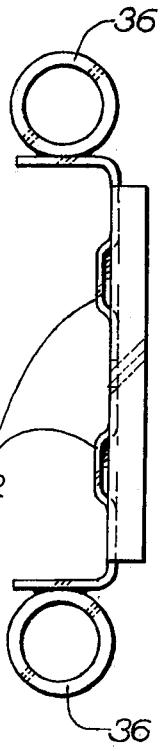
FIG. 8A is an end elevational view of the plate shown in FIG. 8.

The individual panels 10 advantageously have a length that approximates the height of the tank to be insulated and they are mounted and assembled together against the cylindrical wall 24 of the tank 5 in the following improved fashion. A plurality of track courses or trackways 26, each of which is comprised of a plurality of individual channel or C-shaped track segments 28 are horizontally mounted in generally spaced and parallel arrangement on the outside surface of the main tank wall 24. The courses are attached initially in the following fashion. The individual segments 28 of the topmost course may be loosely held in place by strap or clip elements 29 that can be secured to or draped over the top of wall 24 provided with the overhanging flashing or coping 27. Clips 29 engage the lips 29' of the G-shaped segments 28 of a track 26. Straps 29 hold the segments 28 of the topmost track 26 in place until these segments 28 are joined together to form a continuous relatively uninterrupted band or trackway by means of the splice plates 30 and take-up fittings 31. The lower track courses can be suspended from the top course and each other in like fashion. A splice plate 30, which is advantageously channel-shaped but of a slightly larger size than a track segment 28 so as to fit comfortably over and about the ends of a pair of adjacent track segments 28, is provided with suitably shaped struck-out portions 32 as noted particularly in FIGS. 3 and 8. These appropriately patterned struck-out portions, e.g. they can be generally half circular in shape, are adapted to fit within the correspondingly shaped and matching, but slightly larger dimensioned openings 34 in the opposing end sections of certain adjacent track segments 28. As indicated in FIGS. 2 and 3 the struck-out portions or lugs 32 on one side of a plate 30 are reversely oriented relative to similar lugs on the other side of the same plate. By virtue of using this opposing lug orientation and splice plate and track segment interfit, individual sections of one track course 26 can be readily assembled and maintain contact at a series of points and with a minimum of bolts. The ends of the opposing track segments joined by a plate 30 are prevented from riding up over the struck-out lugs 34 due to the reverse lug orientation. Only two bolts 35 and nuts 35' need be used for each installation of a plate 30, one such bolt and nut assembly for each segment 28 being joined to the plate.

With further reference to the drawings and particularly FIG. 2, a preferred embodiment of the invention contemplates that opposing and adjacent end sections of other selected track segments in the same course would be joined together by take-up fittings 31. These fittings as noted particularly in FIGS. 2 and 8 come in pairs and are likewise channel-shaped, apertured and substantially identical in design to the splice plates 30 with the exception that welded or otherwise secured to the outside surfaces of the flanges of these plates are tubular elements 36. Each tubular element 36 is adapted to receive an elongated pass through bolt 38. The threaded end of a bolt 38 may be optionally fitted with a tensioning spring 40 in addition to the usual washers 41 and one or more tightening nut elements 42, all as shown in FIG. 2.

As noted, each individual trackway or course can be held in place by way of strip elements 29 until all the alternately arranged take-up fittings and splice plates have been installed. Thereafter, the strip elements can be removed and the individual tracks 26 allowed to rest against the tank wall by virtue of the cinching of the tracks against the wall. In this connection, and regardless of whether tension springs 40 or the like are used, a simple torque wrench can be applied to the head end of the bolts 38 for effecting a predetermined and advantageous torquing of the bolts 38 and a selected pretensioning of the individual tracks 26 about the tank wall.

When all of the track courses are in position, panels 10 are anchored cross-wise to the individual channel or C-shaped tracks 26 in the following fashion by means of standard upstanding anchoring clips 44. Each anchoring clip 44 is provided with a foot section 44' which fits within the recess 45 of a C-shaped track segment 28 after this foot section is first aligned with the opening between lips 29' and then rotated to project underneath the same. Clip 44 further includes a main body portion 46 and a head portion 48 made up of alternately disposed prongs 50. These prongs are adapted to fit within and engage opposing sides of the beaded portion 16 of one of the panels 10. When the deformable sleeve 18 of the adjacent panel is folded over and form fitted about the bead 16 that contains an anchoring clip, both panels 10 will be held in place against the associated track 26. This same operation takes place along the length of each panel at the points of juncture of a panel and a track until all of the panels 10 are in position. The sleeve 18 of one panel can be folded about the bead 16 of an adjacent panel by means of an electric powered tool provided with crimping rollers that engage the sleeve 18 on one panel and progressively fold it over the bead 16 on the adjacent panel. This same tool can be of the self-propelling kind whereby it propels itself along the matching ribs or flanges 14 of the adjacent panels to produce a continuous tight seam between adjacent panels and with the anchor clips in turn being locked within the closed ribs. When installed, the tops of panels 10 fit within and below the tank overhang plate 27 and the bottoms of the panels 10 can rest upon a block 54 of insulation, a base plate 56 and asphalt paving 58.

The bead 16 of a panel 10 may be so fabricated as indicated in the aforementioned U.S. Pat. No. 3,555,758 that is provided with an anti-siphon groove and the overall panel structure or covering is relatively continuous with no holes being provided in the exterior surface which not only are unsightly, but could provide areas for corrosion.

By virtue of the aforesaid apertured splice clips 30 and take-up fittings 31 with their bolts 38, the track segments are joined together in a pretensioned fashion with minimal bolts and the insulation jacketing is able to absorb the thermal movements without the structural integrity of the insulated panels being adversely affected. The anchor clips 44 can tolerate both limited vertical and transverse thermal movement of the panels and the particular configuration of the panels helps to provide for absorption of transverse thermal movement. Wind loads imposed on the panels during normal use, even if severe, are adapted to be advantageously resisted by virtue of the tensile strength of the track as it is subjected to the wind loads indicated by the arrows W of FIG. 7. These wind loads W are resisted by the tensile forces simultaneously exerted by the track 26 in the direction of the arrows T in FIG. 7 so that the overall tank wall and panel assembly will remain in intimate contact. The multi-perforated openings and projections of take-up devices 31 and splice plates 30 used in securing the ends of various adjacent and opposing track segments to each other materially help in transferring and distributing the tensile loads from track segment to track segment over a number of points such that nearly the full tensile strength of the track is developed at the various joints thereof.

An advantageous embodiment of the invention has been shown and described. It is obvious that various changes may be made therein while remaining within the scope of the appended claims, wherein:

What is claimed is:

1. An insulated jacketing system for an upstanding cylindrical tank wall and the like comprising at least one pretensioned circular track means made up of a plurality of individual track segments each having multi-perforated ends disposed immediately adjacent the tank wall and each of which is provided with an outwardly facing recess, means for splicing certain opposing and adjacent multi-perforated ends of selected track segments together, said means comprising a splice plate provided at each of its ends with a plurality of struck out lug portions engageable with a corresponding plurality of similarly shaped and matching perforations on the said ends of the selected track segments, track take-up means including rod elements and plates having multi-struck out lug elements engaging and holding other opposing and adjacent multi-perforated ends of selected track segments together, the splice plate and the take-up plate each are channel shaped in cross section, insulated panels secured crosswise to said track segments, said panels comprising channel-shaped sections having opposing upstanding flanges one of which comprises a terminal bead and the other of which comprises a deformable sleeve that can be folded tightly about the bead on a similarly configured channel-shaped section disposed adjacent thereto, insulating material affixed to the underside of each panel and clip means provided with a head portion insertable within and engageable with the bead of one panel and a foot element insertable within the outwardly facing recess of a track segment.

2. A system as set forth in claim 1 wherein a track segment comprises a channel-shaped section provided with inturned flanges for directly contacting and supporting the insulated panels.

3. A system as set forth in claim 1, wherein the struck out lug portions of the splice plate are reversely oriented on opposite ends of the plate.

4. A system as set forth in claim 3 wherein the track take-up means includes a channel-shaped plate for receiving selected parts of the rod elements.

5. A system as set forth in claim 1 wherein the rod elements are torque rod elements.

6. An insulated jacketing system for an upstanding cylindrical tank wall comprising a plurality of pretensioned circular trackways horizontally arranged in a generally parallel and spaced relation to each other along and in contact with the wall, each trackway being made up of a plurality of individual track segments and each track segment being generally channel-shaped in cross-section so as to be provided with an outwardly facing recess, splice plate means for splicing the opposing and adjacent ends of selected track segments together, said splice plate means having a plurality of struck out lug portions at each end of the splice plate means insertable within a corresponding plurality of similarly shaped and matching apertures on the said ends of the track segments, a track take-up means comprised of a pair of plates each of which is provided with multiple lugs insertable within similarly shaped and matching apertures on the end of a selected track segment and torque rod elements engageable with each plate, the splice plate and the take-up plate each are channel shaped in cross section, insulated panels secured crosswise of and upon said track segments, said panels comprising channel-shaped metal sections having opposing upstanding flanges one of which comprises a terminal bead and the other of which comprises a deformable sleeve that can be folded tightly about the bead on a similarly configured channel section disposed adjacent thereto, insulating material affixed to the underside of each panel and clip means portions of which are engageable with the bead of one panel and a track segment for securing the panels crosswise to the track segments.

7. A system as set forth in claim 6 wherein the channel-shaped track segments are provided with flanged lips that act as bearing surfaces for the insulated panels.

8. A system as set forth in claim 6, wherein the struck out lug portions of the splice plate means are reversely oriented on opposite ends of the plate means.

* * * * *